US008444538B2

(12) United States Patent
Knopf et al.

(10) Patent No.: US 8,444,538 B2
(45) Date of Patent: May 21, 2013

(54) IMPRESSION ROLLER AND USE OF THE SAME

(75) Inventors: Franz Knopf, Buhl (DE); Lukas Hahne, Allschwil (CH); Thomas Litterst, Weil am Rhein (DE)

(73) Assignee: Illinois Tool Works, Inc., Glenview, IL (US)

( * ) Notice: Subject to any disclaimer, the term of this patent is extended or adjusted under 35 U.S.C. 154(b) by 485 days.

(21) Appl. No.: 12/812,305

(22) PCT Filed: Jan. 23, 2009

(86) PCT No.: PCT/US2009/031765

§ 371 (c)(1),
(2), (4) Date: Jul. 9, 2010

(87) PCT Pub. No.: WO2009/094499

PCT Pub. Date: Jul. 30, 2009

(65) Prior Publication Data

US 2010/0285228 A1 Nov. 11, 2010

(30) Foreign Application Priority Data

Jan. 25, 2008 (DE) ..... 10 2008 006 269

(51) Int. Cl.
*B25F 5/02* (2006.01)

(52) U.S. Cl.
USPC ..... 492/49; 492/53; 101/489; 29/846

(58) Field of Classification Search
USPC ..... 101/153, 489; 29/831, 846; 347/111–170; 427/428.06; 492/49, 53
See application file for complete search history.

(56) References Cited

U.S. PATENT DOCUMENTS 3,477,369 A * 11/1969 Coberley et al. ..... 101/153
3,619,720 A * 11/1971 Coberley ..... 361/86
3,625,146 A * 12/1971 Hutchison ..... 101/143
4,208,965 A * 6/1980 Eichler et al. ..... 101/219

(Continued)

FOREIGN PATENT DOCUMENTS

| | | |
|---|---|---|
| EP | 0351504 A2 | 1/1990 |
| EP | 0556463 A1 | 8/1993 |
| EP | 1072406 A1 | 1/2001 |
| WO | 98/03049 A2 | 1/1998 |

OTHER PUBLICATIONS

ISR for PCT/US2009/031765 dated May 11, 2009.

*Primary Examiner* — David Bryant
*Assistant Examiner* — Jacob Cigna
(74) *Attorney, Agent, or Firm* — Lowe Hauptman Ham & Berner, LLP

(57) ABSTRACT

An impression roller for gravure printing for use with an electrostatic printing aid, including an axis member or a shaft, joined axially to a steel core, an electrical inner insulating layer extending radially around the core, an electrically semi-conductive outer layer adjoining the outside of the impression layer, and an electrically highly conductive conductor layer arranged between the two. The conductor layer is encapsulated in an electrically insulated exterior. The impression roller is provided with an electric or electronic encapsulated circuit electrically insulated from the outside and having two poles, which is of low resistance in normal operation when the electric current flows from its positive pole to its negative pole and is of high resistance when the flow direction is opposite. The inner pole and outer pole of the circuit are connected to the conductor layer by an inner and outer connection of the impression roller respectively.

10 Claims, 1 Drawing Sheet

Figure 1:
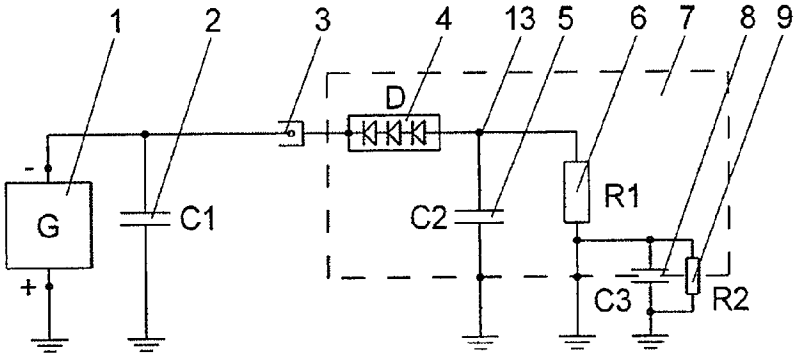

U.S. PATENT DOCUMENTS 4,360,850 A * 11/1982 Howard et al. ..... 361/56
4,364,313 A * 12/1982 Hyllberg ..... 101/401.1
5,044,275 A * 9/1991 Knopf et al. ..... 101/153
5,178,071 A * 1/1993 Hyllberg ..... 101/489
5,243,487 A * 9/1993 Klett ..... 361/56
5,322,011 A * 6/1994 Hahne et al. ..... 101/153
6,508,174 B1 * 1/2003 Hahne et al. ..... 101/489
6,578,478 B2 * 6/2003 Doppler ..... 101/153

* cited by examiner

IMPRESSION ROLLER AND USE OF THE SAME

RELATED APPLICATIONS

The present application is national phase of International Application Number PCT/US2009/031765, filed Jan. 23, 2009, and claims priority from, German Application Number 10 2008 0062 69.3, filed Jan. 25, 2008, the disclosures of which are hereby incorporated by reference herein in their entirety.

The invention relates to a generic impression roller according to the preamble of the product main claim, that is, an impression roller for gravure printing for the use with an electrostatic printing aid, comprising an axis member or a shaft, comprising preferably three layers, i. e., a steel core adjoining axially thereto under formation of a respective end, an electrical inner insulating layer extending around said core in a radial direction, an electrically semi-conductive outer layer adjoining the outside of the impression roller, and comprising an electrically highly conductive conductor layer arranged between the outer layer and the insulating layer, as well as to the use of the impression roller.

Many embodiments of electrostatic printing aids having a generator for high direct voltages are sufficiently known. The effect and mode of operation of such printing aids have also been described in detail. The common fact of all of these embodiments is that in the printing gap, which is also called a printing nip, an adjustable electric direct voltage is provided, depending on the substrate to be printed, for generating an electric field in the printing gap of the generator within the limits during the printing process. If the printing colors contain flammable solvents, all electrical operating means in the gravure printing mechanism, in particular high voltage generators, require a special approval for potentially explosive environments.

There is known a generic so-called three-layer impression roller (ER-0351504-A1). Generally, the required three layers are arranged on the steel core of the impression roller, which is moreover grounded by way of the grounded axis member or shaft. One layer lies on the steel core as an insulating layer, the second layer is a low resistance conductor layer for a distribution of the electric potential as unresisting as possible in the circumferential and axial directions of the impression roller and the third impression roller has e.g. semi-conductive rubber or polyurethane the Shore hardness of which must satisfy the requirements of gravure printing. Such known three-layer impression rollers do not require an insulated installation of the impression roller bearings into the machine frame of the printing mechanism (as do, for example, EP-0556463-A1 and EP-1072406-A1), their axis member or shaft being on ground potential. This is a particular advantage in retrofitting electrostatic printing aids in existing gravure printing machines wherein the retrofit insulation of the bearing cannot be realized at all or only in connection with disproportionately high costs.

However, a serious drawback of these generic impression rollers lies in the fact that caused by design and due to their structure they have a large capacitance formed by the steel core, the insulating layer and the conductor layer and insofar, upon their discharge, they thus represent a potential source of ignition which even in an operation with high voltage generators approved for potentially explosive environments results in the loss of their operating license for the type of protection of inherent safety.

It is the object of the invention to improve a generic impression roller according to the preamble of the product main claim such that it can be used even in an operation with high voltage generators approved for potentially explosive environments and does not lead to the loss of their operating license for the type of protection of inherent safety.

According to the invention, this object is achieved by a generic impression roller according to the preamble of the main claim by its characterizing features, i. e. by the fact that the conductor layer is encapsulated in an electrically insulated manner from the outside, that the impression roller is provided with an electric or electronic circuit encapsulated in an electrically insulated manner from the outside and comprising two poles, which, with respect to the one flow direction of the electric current from its positive pole to its negative pole is of low resistance in normal operation (forward direction) and in the flow direction opposite thereto (reverse direction) is of high resistance in the event of a failure and that the one inner pole of the circuit is connected to the conductor layer by way of an inner connection and the outer pole of the semiconductor is connected to an outer connection of the impression roller for connecting to a generator, and by the ancillary use of an inventive impression roller according to one of the preceding claims which is formed with an outer connection as a slip-ring, slip-ring brush, contact roller or contact spring in combination with a generator designed according to the type of protection of inherent safety.

According to the teaching of the invention the conducting conductor layer is thus embedded and encapsulated in an electrical insulator such that the layer has no direct contact to the outside, for example a potentially explosive environment, and therefore is insulated therefrom. It is connected only electrically to the outer connection by way of the electric or electronic circuit which, however, with respect to the used connection of the generator prevents the capacitance of the impression roller from discharging with low resistance by way of the outer connection in the event of a failure, for example a short circuit, under generation of an ignitable discharge spark on the one hand, but on the other hand allows the charge current for normal operation of the impression roller to flow through. The circuit itself is also encapsulated and embedded in an encapsulated insulator electrically insulated from the outside. Thus, an ignitable discharge spark can by no means originate from the conductive layer.

Therefore, in a practical embodiment of the invention for the purpose of charging the capacitance of the impression roller from the generator to the impression roller there will always result a connection of low resistance in normal operation with respect to the one flow direction of the electric current from its positive pole to its negative pole and a high resistance connection in the event of a failure in the flow direction opposite thereto of the electric discharge current if its negative pole is selected as an outer pole of the semiconductor upon connection to the negative output of the generator and its positive pole is selected upon connection to the positive output of the generator.

Advantageously, the semiconductor is in the form of at least one semiconductor diode. For reasons of safety, three semiconductor diodes biased in the same direction may be provided in series connection such that safety continues to be guaranteed even in case of a breakdown of one semiconductor diode.

Preferably, the inventive impression roller is used in combination with such generator (EP-1072406-A1) which has inherent safety at the outer connection point as the type of protection according to European standard EEx ib IIB.

The subsidiary claims recite further practical and advantageous embodiments and advanced versions of the invention.

Figure 2:
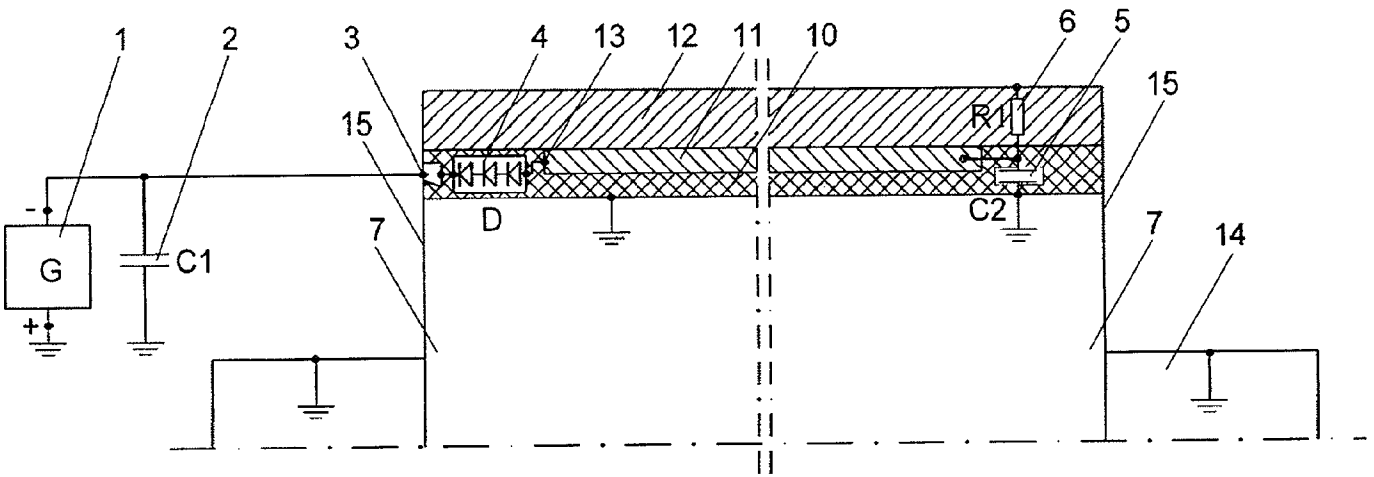

One embodiment of the invention is explained below in more detail with reference to the drawing wherein:

FIG. 1 shows the electrical equivalent diagram of an impression roller according to the invention, and FIG. 2 shows a schematic cross-section of the impression roller according to the invention.

FIG. 2 schematically shows an impression roller for gravure printing for the use with an electrostatic printing aid. It is provided with an axis member or shaft 14 on ground potential, a steel core 7 also grounded and adjoining axially thereto under formation of a respective end, an electrical inner insulating layer 10 extending around the core in a radial direction, an electrically semi-conductive outer layer 12, and an electrically highly conductive conductor layer 11 arranged between the outer layer and the insulating layer 10, which therefore radially adjoins neither the steel core 7 nor the outside, for example the ambient air of the potentially explosive area of the printing machine, when a printing color comprising a flammable solvent is used.

In the embodiment as shown the conductor layer 11 ends at a distance from each of the two ends 15 of the impression roller such that it does not have any direct contact either in the axial direction outwards to the outside, for example the potentially explosive environment, and thus is embedded completely insulated therefrom in an encapsulation of an electric insulator in the sense of a low resistance electrical connection.

Furthermore, an electric or electronic circuit having two poles and designed as a semiconductor 4 is embedded in the insulator layer 10, which in the embodiment as shown is in the form of a series connection of three semiconductor diodes D biased in the same direction and which, with respect to the one flow direction of the electric current, that is, the forward direction of the semiconductor diodes D, from its positive pole (anode) to its negative pole (cathode) shows low resistance in normal operation and in the flow direction opposite thereto, that is, the reverse direction of the semiconductor diodes D, shows high resistance in the event of a failure, with an inner pole of the semiconductor 4 being connected to the conductor layer 11 by way of an inner output 13 and the outer pole of the semiconductor 4 being connected to an outer output 3 located in one of the two ends. The conductor layer 11 is electrically connected to the outer output 3 only by way of the semiconductor 4 which may be in the form of a slip-ring, slip-ring brush, contact roller or contact spring and which is connected by way of a non-shielded connection cable to a generator G 1 for high direct voltage comprising a negative output (−) as well as a positive output (+), wherein on the one hand the capacitance of the impression roller is prevented from discharging with low resistance by way of the outer connection under formation of an ignitable discharge spark by means of a discharge current, but on the other hand allows the charging current for the normal operation of the impression roller to flow through. Thus, it is by no means possible that an ignitable discharge spark originates from the conductive layer. Rather, for the purpose of charging the capacitance of the impression roller a low resistance connection with respect to the one flow direction of the electric current from its positive pole to its negative pole and a high resistance connection in the flow direction opposite thereto of the electric discharge current will always be established.

For this purpose—depending on the biasing of the semiconductor diodes D—the negative pole will be selected as the outer pole of the semiconductor 4 upon connection to the negative output (−) of the generator 1 and the positive pole of the semiconductor diodes D 4 will be selected upon connection to the positive output (+) of the generator G 1. The respective other output of the generator G 1, the positive (+) output in the embodiment as shown, will be grounded.

As shown in FIG. 1 in detail, the capacitance 2 represents a capacitor $C_1$ of the non-shielded connection cable of about 100 pF and 8 represents the so-called printing nip capacitance of the capacitor $C_3$ in the printing gap. The latter can discharge only slowly with a large time constant or by way of the electric (volume) resistor 6 of the magnitude $R_1$ formed by the semi-conductive layer 12 and/or by way of the electric (volume) resistor $R_2$ formed by the substrate 9 to be printed if in the event of a failure a grounded object initiates the discharge upon contacting the layer 12 of the impression roller. Therefore, the capacitance $C_3$ drops out as a source of ignition due to the low possible energy density of a discharge spark and a holistic look does not contribute significantly either to a possible ignition. Due to the substrate to be printed the resistor $R_2$ is highly resistant within the printing width. Although this resistance disappears outside the printing width, because there the semi-conductive layer 12 contacts the grounded printing cylinder, its resistor $R_1$ suffices for a time constant for preventing an ignitable discharge spark which is confirmed by extensive experiments and 30 years of practical use of various large generic impression rollers, even three-layer impression rollers of a working width of up to 4.2 m.

5 denotes the capacitance $C_2$ of the capacitor formed by the steel core 7, the insulating layer 10 and the conductor layer 11, the capacitor being discharged only slowly and without the risk of a discharge spark of sufficient energy and solely with the resistor 6 of the magnitude $R_1$ by way of the same with a time constant $R_1 * C_2$ and due to the relative magnitude of $R_1$.

It can be taken from the drawing that above all the overall capacitance of the capacitances $C_1$ and $C_2$ connected in low resistance by way of the non-shielded connection cable needs to be considered, which overall capacitance may discharge upon any contact with a grounded object by way of the outer connection 3 with a spark of high energy density that might lead to the solvent being ignited. Practically admissible upper limits for the maximum capacitive load without the risk of generating ignitable sparks are in the range of 300 pF, however, depend on the admissible maximum output voltage of the generator. If this capacitance $C_2$ is calculated for common impression roller dimensions and common layer thicknesses for the insulator having a relative dielectric constant of, for example, $\in$=2.5, three-layered impression rollers of a width of 1 m already have a capacitance $C_2$ of up to 6,000 pF, the same increasing proportionally to the width of the impression roller. Such value is approximately one order of magnitude above the admissible value of about 300 pF ($C_1$+$C_2$) of an impression roller approved for the type of protection of inherent safety; and nearly two orders of magnitude in practically used impression rollers of a width of up to 4.2 m.

Due to the inventive embedding of the conductor layer 11 the capacitance $C_2$ may discharge in the event of a failure only by way of the outer connection 3 as a discharge current as opposed to the charging current flowing in normal operation, which, however, is so small in the reverse direction of the semiconductor diodes D via their high ohmic resistance that no ignitable discharge spark is generated. Accordingly, no particular requirements need to be observed for the outer connection with the exception of the amount of its design-caused capacitance with a view to the explosion protection, which may possibly add to $C_1$ and/or $C_2$.

The three layers 10, 11, and 12 may also be implemented in the increasingly used so-called sleeve technique. Such sleeve may be virtually mounted and dismounted in a simple manner as a jacket in a state radially expanded by means of compressed air on the steel core of the impression roller, In packaging gravure printing this sleeve technique allows the changing of such sleeves on the steel core of the impression roller, which constantly is of the same width, with little effort for various printing widths, and thus they are clearly more cost-efficient than a totally new impression roller for every single printing width.

Naturally, the outer connection 3 may also lead out at the circumference of the impression roller if the part referring thereto of the impression roller extends beyond the working width and thus preferably has a smaller diameter. According to the invention, in an alternative embodiment of the invention, the axis member and shaft 14, respectively, which are not on ground potential, and/or the steel core 7 may preferably be connected to the outer connection 3 by way of an outer and/or an inner electric connection.

We claim:

1. An impression roller for gravure printing for the use with an electrostatic printing aid, comprising:

an axis member or a shaft, a steel core adjoining axially thereto under formation of a respective end, an electrically insulating inner layer extending around said core in a radial direction, an electrically semi-conductive outer layer adjoining an outside of said impression roller, and an electrically highly conductive conductor layer arranged between the electrically semi-conductive outer layer and said electrically insulating inner layer, wherein said conductor layer is encapsulated in an electrically insulated manner from the outside, said impression roller is provided with an electric or electronic encapsulated circuit electrically insulated from the outside and having two poles, which, in a flow direction of the electric current from one pole to another pole is of low resistance in normal operation and in an opposite flow direction is of high resistance in the event of a failure, and an inner pole of said circuit is connected to said conductor layer by way of an inner connection and an outer pole of said semiconductor is connected to an outer connection of said impression roller for connecting to a generator.

2. The impression roller according to claim 1, wherein said conductor layer ends at a distance to every end of the impression roller for the purpose of an encapsulation electrically insulating from the outside.

3. The impression roller according to claim 1, wherein said circuit is embedded in said electrically semi-conductive layer and/or said insulating layer for the purpose of an encapsulation electrically insulating from the outside.

4. The impression roller according to claim 1, wherein said electric or electronic circuit has at least one semiconductor.

5. The impression roller according to claim 1, wherein said outer connection is arranged in one of said two ends of said impression roller.

6. The impression roller according to claim 1, wherein said generator is designed for high direct voltage.

7. The impression roller according to claim 1, wherein the outer pole of said semiconductor is a negative pole upon connection to the negative output (−) of the generator and the inner pole is a positive pole upon connection to the positive output (+) of the generator.

8. The impression roller according to claim 1, wherein said electrically insulating inner layer, said conductor layer, and said electrically semi-conductive outer layer are implemented in a sleeve technique on said steel core.

9. The impression roller according to claim 1, wherein said semiconductor is in the form of at least one semiconductor diode.

10. The impression roller according to claim 9, wherein three semiconductor diodes biased in the same direction are provided in a series connection.

* * * * *